US012151727B2

(12) United States Patent
Hammerl

(10) Patent No.: US 12,151,727 B2
(45) Date of Patent: Nov. 26, 2024

(54) RAIL-BOUND TRACK SECTION EQUIPPED WITH AN AUTOMATIC TRAIN PROTECTION SYSTEM AND METHOD FOR OPERATING THE SAME

(71) Applicant: SIEMENS MOBILITY GMBH, Munich (DE)

(72) Inventor: Malte Hammerl, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 358 days.

(21) Appl. No.: 16/988,867

(22) Filed: Aug. 10, 2020

(65) Prior Publication Data

US 2021/0039694 A1 Feb. 11, 2021

(30) Foreign Application Priority Data

Aug. 9, 2019 (DE) ..... 102019211966

(51) Int. Cl.

| | |
|---|---|
| ***B61L 27/30*** | (2022.01) |
| ***B61L 27/20*** | (2022.01) |
| ***B61L 27/37*** | (2022.01) |
| ***B61L 27/40*** | (2022.01) |
| ***B61L 27/70*** | (2022.01) |

(52) U.S. Cl.

CPC ..... *B61L 27/30* (2022.01); *B61L 27/20* (2022.01); *B61L 27/37* (2022.01); *B61L 27/40* (2022.01); *B61L 27/70* (2022.01); *B61L 2027/204* (2022.01)

(58) Field of Classification Search

CPC ..... B61L 27/20; B61L 27/30; B61L 27/37; B61L 27/40; B61L 27/70; B61L 2027/204

See application file for complete search history.

(56) References Cited

U.S. PATENT DOCUMENTS

| | | | | |
|---|---|---|---|---|
| 2014/0209753 | A1* | 7/2014 | Takahashi | B61L 3/227 246/122 R |
| 2014/0209755 | A1* | 7/2014 | Takahashi | B61L 15/0063 246/167 R |
| 2015/0251676 | A1* | 9/2015 | Golden | B61L 27/20 701/19 |
| 2019/0054942 | A1* | 2/2019 | Carlson | B61L 15/0072 |
| 2019/0263432 | A1* | 8/2019 | Carlson | H04W 4/42 |

FOREIGN PATENT DOCUMENTS

| | | | |
|---|---|---|---|
| DE | 102016203694 | A1 | 9/2017 |
| DE | 102016203695 | A1 | 9/2017 |
| KR | 101784393 | B1 | 11/2017 |

* cited by examiner

*Primary Examiner* — Zachary L Kuhfuss

(74) *Attorney, Agent, or Firm* — Laurence A. Greenberg; Werner H. Stemer; Ralph E. Locher

(57) ABSTRACT

A rail-bound track section is equipped with an automatic train protection system. The train protection system is a combined train protection system with the functionality of a first automatic train protection system and the functionality of a second automatic train protection system. The combined train protection system takes trains equipped with the second train protection system in the track section into account during a control of trains equipped with the first train protection system, and also takes trains equipped with the first train protection system in the track section into account during a control of trains equipped with the second train protection system. A method for operating a rail-bound track section equipped with an automatic train protection system is also provided.

7 Claims, 1 Drawing Sheet

RAIL-BOUND TRACK SECTION EQUIPPED WITH AN AUTOMATIC TRAIN PROTECTION SYSTEM AND METHOD FOR OPERATING THE SAME

CROSS-REFERENCE TO RELATED APPLICATION

This application claims the priority, under 35 U.S.C. § 119, of German Patent Application DE 10 2019 211 966, filed Aug. 9, 2019; the prior application is herewith incorporated by reference in its entirety.

BACKGROUND OF THE INVENTION

Field of the Invention

The invention relates to a rail-bound track section equipped with an automatic train protection system. The invention further relates to a method for operating a rail-bound track section that is equipped with an automatic train protection system.

Train protection systems serve to prevent excessively high speeds, derailments and collisions between rail vehicles. They typically cooperate with signal boxes which set routes for trains through switch areas and also prevent collisions.

An overlay train protection system PTC (Positive Train Control), which is specified for U.S. American goods traffic, can be added to existing sections equipped only with signal boxes. In the traditional U.S. American railway traffic, which has manual train path management, it provides protection against:

excessively high speed of travel, the passing of incorrectly set switches, the passing of a signal indicating stop, entry into a track section protected for construction work.

Elements disposed at the trackside (wayside segment) and centrally located wayside train protection facilities (back office segment), the latter together also being designated as wayside train protection facilities, communicate partially bidirectionally (communication segment) with a vehicle-side train protection facility (locomotive segment). If the vehicle-side train protection facility identifies a mismatch between speed, route database and received data, the train is automatically braked. PTC has become established as a standard in the U.S. and by the end of 2020 will have penetrated into almost all of the long distance and goods traffic railway routes. Many locomotives that are used in the U.S. also travel to Canada.

CBTC (Communication-Based Train Control), by contrast, is a train protection system that was developed for local traffic routes and metro systems, that is, on self-contained networks, e.g. within or close to a metropolitan area, typically not more than 100 km. Vehicle-side, wayside and wayside centrally located train protection facilities, communicate with one another mainly bidirectionally and provide for a continual guidance of all trains, including braking ahead of danger points. CBTC is typically offered and installed with a signal box and operational control technology as an integrated system. As a result of permanent communication between all of the train protection facilities, that is, the train-side and wayside facilities, CBTC offers a higher level of protection against collisions and simultaneously, a higher train throughflow. CBTC therefore includes all of the functions that PTC offers, but also offers further functions.

In North America (i.e. the U.S. and Canada), metropolitan areas extend ever further beyond previous city boundaries. Modern train protection systems such as CBTC are already in use there for a high train throughflow and for high security. That applies not only for newly built metro routes, but also for existing regional and long-distance routes, where regional trains, long-distance trains and goods trains share the railway infrastructure.

In Canada, however, regional, long-distance and goods traffic railway routes and trains have no train protection system until today, but are guided by manual signal boxes. If CBTC equipment is now provided for the local or regional traffic trains of a metropolitan area, the problem arises that long-distance trains and goods trains are not equipped, since they belong to other businesses and a large number of different traction vehicles travel through the metropolitan area (and the equipping thereof would not be economical).

Although CBTC systems also support mixed train traffic through their cooperation with signal boxes, that is, the fundamental protection of CBTC trains against foreign traffic on the controlled route, the foreign trains nevertheless remain, in principle, without any vehicle-side train protection system. An excessively high speed of travel, stopping before a signal showing stop or wrongly set switches, are therefore not monitored in any way.

U.S. Publication No. 2014/0209753 A1 describes a ground-based device which transfers train control information to an on-board device mounted in a train. The ground-based device receives a train identification signal from a train with an ATC on-board device mounted thereon through antenna loops and receives a train position signal from a train with a CBTC on-board device. On the basis of the train identification signal and the train position signal, the ground-based device acquires the position of each train on the track and generates the control information for each train. The ground-based device converts the control information into an ATC signal and a CBTC signal.

BRIEF SUMMARY OF THE INVENTION

It is accordingly an object of the invention to provide a rail-bound track section equipped with an automatic train protection system, which overcomes the hereinafore-mentioned disadvantages of the heretofore-known track sections of this general type and which, in route systems in which a train protection system, for example, a CBTC system is installed, ensures the most secure possible conducting through of trains equipped not with this train protection system but with another train protection system.

It is a further object of the invention to provide a method for operating a train protection system with which the most secure possible conducting through of trains equipped not with this train protection system but with another train protection system can be ensured.

With the foregoing and other objects in view there is provided, in accordance with the invention, a rail-bound track section (SA) equipped with an automatic train protection system, wherein the train protection system is a combined train protection system with the functionality of a first automatic train protection system and the functionality of a second automatic train protection system, and the train protection system:

is configured to take trains equipped with the second train protection system in the track section into account during the control of trains equipped with the first train protection system, and is configured to take trains equipped with the first train protection system in the track section into account during the control of trains equipped with the second train protection system.

Through the use of the combined protection system, it is possible, according to the invention, that both trains which are equipped with the first train protection system as well as trains which are equipped with the second train protection system can be safely conducted through the track section. This is referred to as a "mixed operation." This can advantageously be carried out particularly safely because the combined train protection systems are—as it were—not "blind" for one of the two respective train types (meaning that trains are respectively equipped with the first automatic train protection system or with the second automatic train protection system). Mixed operation can thus be monitored gaplessly with the combined train protection systems, whereby a noticeable gain in safety is achieved. Furthermore, in this way, the trains that are equipped with one or the other train protection system in each case can be conducted with a shorter interval through the track section. In particular, in times with a high traffic volume (for example, commuter traffic), the efficiency of the track section is therefore advantageously increased.

The invention makes use, for example, of a current development for the Canadian railway market that a growing number of long distance and goods train locomotives in North America are equipped with PTC due to the market penetration in the U.S. These trains also cross the border and therefore run in Canada. The wayside train protection facilities of the CBTC actually cannot communicate with vehicle-side train protection systems of the PTC since these train protection systems are not compatible. Therefore, the wayside equipping with CBTC is without effect for a train equipped with PTC. This is where the invention begins in that the signals emitted by trains equipped with PTC are emulated for CBTC and the signals emitted by the CBTC train protection facility are emulated for PTC. According to the invention, a train protection system is proposed which protects trains equipped on the vehicle side only with CBTC and trains equipped on the vehicle side only with PTC, simultaneously on the same track section.

Naturally, a combination of other automatic train protection systems can be implemented according to the invention if they are adapted to one another in the manner described. The train protection systems CBTC and PTC will now be used for the description below, without restricting the generality, since this example enables the general statements to be explained well. However, this does not restrict the invention to these train systems, since the statements can be applied to any other train protection systems.

The modification according to the invention is undertaken primarily wayside or centrally located wayside, since the advantage lies, for example, in being able to continue to operate CBTC vehicle equipment and PTC vehicle equipment as previously. The wayside train protection facility of the system according to the invention provides, for example, CBTC-equipped trains with the communication usual for them and provides, for example, PTC-equipped trains with the communication usual for them.

It is also provided, according to the invention, that first wayside train protection facilities of the first train protection system are disposed at the track section and are configured to transmit data to trains equipped with the second train protection system and to receive data from these trains.

Thus, an amalgamation of the wayside train protection facilities of the two train protection systems is put to use. For this purpose, for example, wayside functions which a so-called PTC back office has previously undertaken are bundled together with CBTC functions in the "CBTC+PTC" wayside train protection facilities according to the invention. In this manifestation, both CBTC-equipped trains and also PTC-equipped trains are supplied quite conventionally with the previous communication and messages, since a train protection system combined in this manner speaks—as it were—both languages.

According to one embodiment of the invention, it is provided that a wayside centrally located train protection facility is configured to track trains equipped with the first train protection system and trains equipped with the second train protection system on the track section simultaneously.

With the manifestations described above, a higher level of protection is already achieved than by neglecting the vehicle-side PTC functionality. However, it can be further increased if the new wayside "CBTC+PTC" facility carries out a joint tracking of PTC trains and CBTC trains. A so-called "tracking map" can thereby be put to use, in which, inter alia, the track section to be monitored (and, in addition, a route network) is stored, so that located trains can be mapped in relation to one another in the tracking map. "Mapped" should be understood to mean a locating process, which certainly does not have to take place graphically, but must merely include a computer-evaluable relation of the trains to one another. An output is naturally possible for the orientation of, for example, personnel.

According to a further embodiment of the invention, it is provided that the combined train protection system is configured to provide trains equipped with the PTC system with a mission which relates to a track length during the passage through the rail-bound track section for which a track clear signal exists. Furthermore, according to an embodiment of the invention, it can be provided that the combined protection system is configured to transfer trains equipped with the PTC system to immediate and gradual or immediate and absolute braking.

PTC trains classically receive from the wayside train protection facility (office segment) only a vague, non-definite so-called "mission" which contains, inter alia, the destination station. The test of whether all of the conditions for proceeding are met takes place in the vehicle-side PTC device. CBTC trains conventionally receive a so-called "movement authority" from the wayside train protection facility, that is, a track length for which continuation of travel is permitted. Since all train positions are effectively known to the novel wayside train protection facility of the train protection system, it can undertake joint tracking and it is particularly advantageous also to transfer to the PTC trains (with a change of the command transferred to them) an immediate and gradual, an immediate and absolute braking, or even a travel authority distance (corresponding to the movement authority). For example, the existing mission can be shortened in such a way that, considered spatially, it does not extend further than a movement authority granted by the CBTC system would extend. During the passage through the track section, if relevant, the mission must be extended together with the traveling PTC train on the track section (simulation of a moving block of the CBTC standard).

Since the vehicle-side PTC device can originate from another railway operating business and also from another signal technology/train protection system manufacturer, it must be assumed that it cannot be altered for the journey in the track section under consideration. The conventional PTC command protocol must therefore be used skillfully so that the PTC vehicle device permits the desired further passage or performs braking, e.g. by simulating a shorter mission than conventionally specified.

According to an embodiment of the invention, it is provided that the combined train protection system is configured to transfer switch settings and signal aspects that have been determined and transferred by wayside safety facilities of the CBTC system to trains equipped with the PTC system.

The PTC wayside segment also includes wayside train protection facilities which measure or register switch settings and signal aspects and transfer them by radio to the approaching train. This information serves the PTC vehicle facility for the comparison as to whether a safe continuation is assured. For the monitoring and guidance of the CBTC trains, the wayside train protection facility of the train protection system according to the invention already has very good knowledge of switch settings und signal aspects. The necessary information access taps must therefore only be provided for PTC trains. For this purpose, a transformation to the PTC standard is also required so that the data transferred can be interpreted by a train equipped with the PTC system.

In other words, the infrastructure made available by the CBTC system is thus used to conduct a train equipped with the PTC system safely through a zone which also belongs to the aforementioned track section. This can be, for example, a metropolitan area in which trains equipped with the PTC system are also to travel. Advantageously, in this zone, no additional infrastructure for conducting the PTC trains has to be kept available, so that costs can be saved.

According to an embodiment of the invention, it is provided that the combined train protection system is configured to transfer switch settings and signal aspects that have been determined and transferred by wayside safety facilities of the CBTC system to trains equipped with the PTC system.

Thus it is advantageous to be able to dispense with parts of the wayside segment of the PTC system, that is, the infrastructure that is made available by the wayside train protection facilities and the direct communication with the approaching train in the combined train protection system, and to make this information available to the train by using the wayside train protection facilities of the CBTC system. In this case also, the existing interoperable protocol must again be used skillfully in such a way that the PTC train is "piloted" through the metropolitan area at an acceptable speed.

With the objects of the invention in view, there is also provided a method for operating a rail-bound track section (SA) that is equipped with an automatic train protection system, in which the train protection system is operated as a combined train protection system in which the functionality of a first automatic train protection system and the functionality of a second automatic train protection system are covered by the combined train protection system, whereby the combined train protection system:

takes into account, in the track section, during the control of trains equipped with the first train protection system, trains equipped with the second train protection system, and takes into account, in the track section, during the control of trains equipped with the second train protection system, trains equipped with the first train protection system.

The method is advantageously suitable according to the invention to be operated on a rail-bound track section as described above. The advantages and properties of the invention set out in relation to the track section according to the invention therefore apply similarly also to the method according to the invention. In particular, it is possible, on the track section, with the method according to the invention, to allow trains of a first train protection system and trains of a second train protection system to operate in parallel, wherein this both meets safety requirements and is also possible cost-effectively.

According to an embodiment of the invention, it is provided that the combined train protection system:

uses a communication protocol of the first train protection system for trains equipped with the first train protection system, and uses a communication protocol of the second train protection system for trains equipped with the second train protection system.

By using respective communication protocols for trains which are equipped with the first train protection system and for trains which are equipped with the second train protection system, it is possible that trains of both train protection systems can be operated simultaneously and that for this purpose, only the combined train protection system according to the invention must be utilized. In other words, a communication interface is offered both for trains which are equipped with the first train protection system and trains which are equipped with the second train protection system. By taking into account the trains of both train protection systems in a combined train protection system, advantageously all trains moving on the track section can be monitored simultaneously in order reliably to prevent collisions.

According to an embodiment of the invention, it is provided that, for the acquisition of data, the combined train protection system uses the first train protection system as a wayside train protection system and, for the output of data to trains equipped with the second train protection system, undertakes a transformation of the data in such a way that it can be used for the communication protocol of the second train protection system.

Since the data acquisition takes place purely by using the infrastructure of the first train protection system, the combined train protection system needs no further infrastructure for the acquisition of the data that must be made available to trains equipped with the second train protection system. According to the invention, this problem is solved with software in that the data is processed (transformed) with computer assistance in such a way that, following a communication protocol for the second train protection system, it can be made available to the trains equipped with the second train protection system in such a way that those trains can process this data. In this way, the effort that would be associated with making available operation and maintenance of an infrastructure of the second train protection system is spared.

According to an embodiment of the invention, it is provided that the first train protection system is a CBTC system and the second train protection system is a PTC system. A method developed in this way can be used, in particular, in the U.S. and Canada, so that a mixed operation can be carried out between long-distance and local traffic in metropolitan areas.

Further details of the invention are explained below, making reference to the drawings. The same or corresponding drawing elements are respectively provided with the same reference signs and will be described multiple times only insofar as differences arise between the individual drawings.

The exemplary embodiments set out in the following are preferred embodiments of the invention. The components of the embodiments as described in the exemplary embodiments each represent individual features of the invention that are to be regarded as independent of one another and each also further develop the invention independently of one another and are thus also to be considered individually, or in a different combination from that shown, as a constituent of the invention. Furthermore, the embodiments described are also enhanceable with others of the previously described features of the invention.

Other features which are considered as characteristic for the invention are set forth in the appended claims.

Although the invention is illustrated and described herein as embodied in a rail-bound track section equipped with an automatic train protection system and a method for operating the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
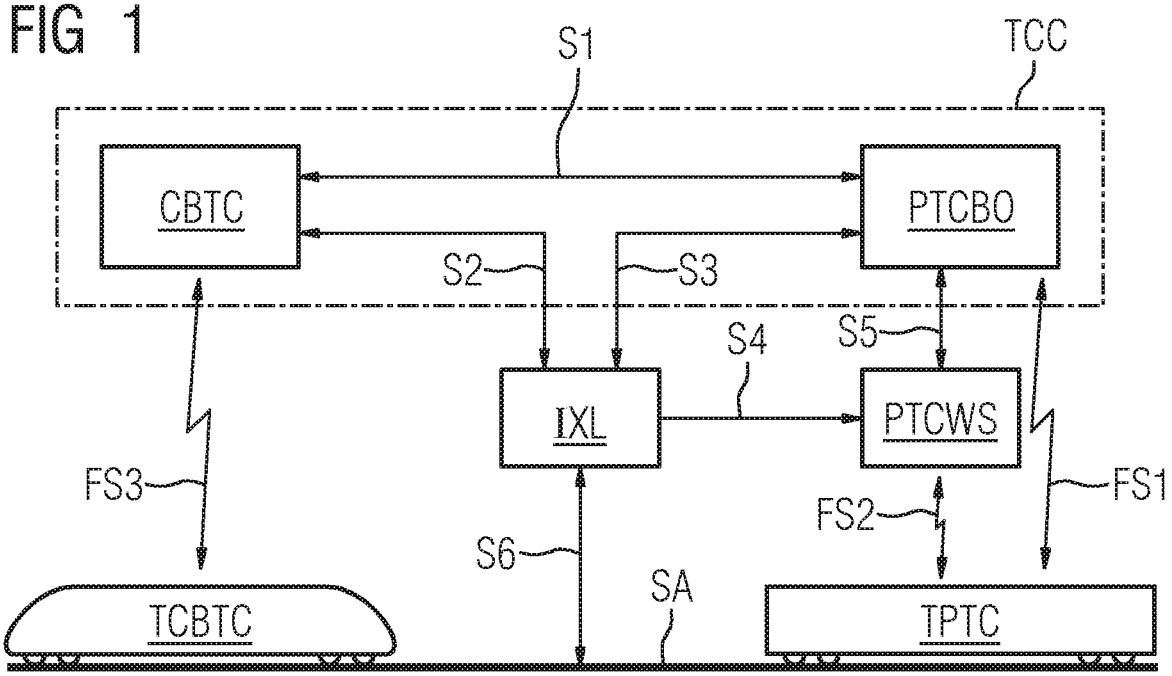
FIGS. 1 and 2 each illustrate an exemplary embodiment of the track section according to the invention on each of which an exemplary embodiment of the method according to the invention can operate, wherein the track sections and the functional units of the combined train protection system necessary for applying the method are shown as a block circuit diagram.

Referring now to the figures of the drawings in detail and first, particularly, to FIG. 1 thereof, there is seen a track section SA on which two trains are moving. The train TCBTC is a train which is equipped on the train side with the train protection system CBTC. This can be, for example, a local traffic train which operates in a metropolitan area. A further train TPTC is also underway on the track section SA. This further train is equipped with the train protection system PTC and could be, for example, a goods or freight train which must cross the metropolitan area on its country-wide route, specifically on the track section SA. These two trains represent a mixed train traffic on the track section SA. Naturally, further trains can be underway, which are not shown for the sake of clarity.

Figure 2:
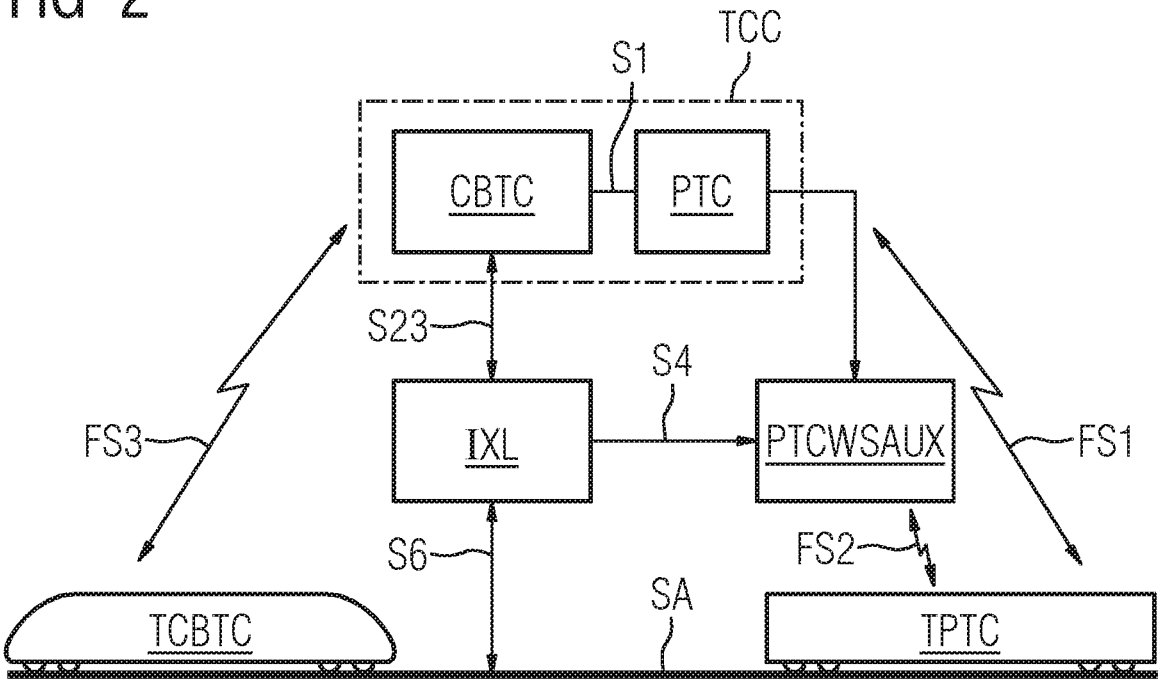

The train TPTC communicates through a first radio interface FS1 with a back office or a control center of the second train protection system, wherein the second train protection system in the exemplary embodiment according to FIGS. 1 and 2 is the PTC system.

Otherwise, apart from the wayside centrally located train protection facility of a control center PTCBO, wayside train protection facilities PTCWS which can be activated through a fifth interface S5 by the control center PTCBO are also provided. Additionally, these wayside train protection facilities communicate with the train TPTC through a second radio interface FS2. In this way, commands which are preferably exchanged through human communication between the train TPTC and the control center PTCBO, can be passed on, for example, at signal installations (not shown) which are an example of wayside train protection facilities PTCWS.

The first train protection system that is represented in the exemplary embodiments according to FIGS. 1 and 2 by a CBTC system functions automatically in a manner known per se, wherein a wayside train protection facility CBTC communicates through a third radio interface FS3 with the train TCBTC and issues to the train an individual clear (moving block) for a particular subsection of the track section SA.

Furthermore, a signal box IXL is provided which can control train protection facilities such as signal installations, but also, for example, switches, through a sixth interface S6. The sixth interface S6 is thus located between the track section SA and the signal box IXL.

The first train protection system with the wayside train protection facility CBTC, the second train protection system with the wayside train protection facilities PTCBO and PTCWS and the signal box IXL function in a manner known per se, so that they will not be described in detail. A communication of the first train protection system CBTC with the signal box IXL through a second interface S2 or a communication of the wayside train protection systems PTCWO through a third interface S3 and of the wayside train protection systems PTCWS through a fourth interface S4 are each known per se. This ensures a functioning of the individual components.

It is additionally provided, according to the invention, that the first train protection system CBTC and the second train protection system PTC are grouped together in a combined train protection system TCC. This therefore represents an innovation since thereby, a mixed operation of the trains TCBTC and TPTC on the track section SA is possible. This is assured by a first interface S1 between the wayside train protection facility CBTC and the wayside second train protection facility PTCBO, which enables the trains of the respective other train protection system to be tolerated on the track section SA during the mixed operation and to be taken into account in the train protection. Otherwise, a "foreign" train would either not be recognized by the relevant other train protection system (and would thus become a safety risk), or would be interpreted as a danger (so that train operation would be discontinued).

FIG. 1 shows that the first interface S1 is operated by the control center of the second train protection system PTCBO. In this case therefore, a manual conducting of the train TPTC equipped with PTC through the track section SA is possible since, by using the first interface S1, the presence of the trains TCBTC equipped with the first train protection system CBTC can be communicated. On the other hand, the automatic first train protection system CBTC can be supplied with the required data through the first interface S1, so that the trains equipped with the second train protection system PTC can be taken into account automatically.

However, the embodiment according to FIG. 1 requires that the track section SA be equipped with both the wayside train protection facilities of the first train protection system CBTC and also with the wayside train protection facilities of the second train protection system PTCWS. This implies a certain expenditure on functional components, which makes the configuration described more expensive.

In FIG. 2, another embodiment of the combined train protection system TCC is shown. Insofar as the embodiment of FIG. 2 overlaps with the embodiment of FIG. 1 in its communication with the trains and with the signal box IXL and the track section SA, the same reference signs are used for similar functions. Merely the differences between FIG. 1 and FIG. 2 will now be considered.

In contrast to FIG. 1, the combined train protection system TCC completely takes over the control of the train TPTC equipped with the second train protection system PTC. In other words, the control center PTCBO is excluded during the passage of the train TPTC and is only responsible for the train TPTC in a manner known per se outside of the track section SA. The combined train protection system TCC can be formed, for example, of a computer in which both the wayside train protection facility CBTC and also the wayside train protection facility PTC are realized. The first interface S1, which indicates that for an orderly operation, data of the respective train protection system must be transferred to the other unit, is also represented in FIG. 2.

The combined train protection system TCC communicates with the signal box IXL, but through a combined interface S23. This interface also transfers data for control of the trains equipped with the second train protection system TPTC, with the trains being configured in a suitable manner so that trains equipped with the second train protection system TPTC "understand" the instructions. The communication with the trains TPTC equipped with the second train protection system takes place directly through the combined train protection system TCC (through the PTC part), and also for the transfer of the instructions at least as an auxiliary measure, a facility PTCWSAUX must be provided. However, the component cost is significantly lower than in the exemplary embodiment according to FIG. 1, where the wayside facility PTCWS on the track section SA must be completely reserved. Therefore, in the exemplary embodiment according to FIG. 2, the component cost is reduced as compared with the exemplary embodiment according to FIG. 1.

REFERENCE SIGNS

SA Track section
TCBTC Train equipped with the first train protection system (e.g. CBTC)
CBTC Wayside first train protection system (e.g. CBTC)
IXL Signal box
TPTC Train equipped with the second train protection system (e.g. PTC)
PTCWS Wayside facility of the second train protection system (e.g. PTC)
PTCWSAUX Auxiliary facility of the second train protection system (e.g. PTC)
PTCBO Control center of the second train protection system
TCC Combined train protection system
S1 . . . S6 First interface . . . sixth interface
FS1 . . . FS6 First radio interface . . . third radio interface

The invention claimed is:

1. A rail-bound track section, comprising: a combined train protection system having a functionality of a first automatic train protection system and a functionality of a second automatic train protection system, said first automatic train protection system being a CBTC system and said second automatic train protection system being a PTC system, said combined train protection system being:

configured to take into account trains equipped with said second automatic train protection system in the track section during a control of trains equipped with said first automatic train protection system, and configured to take into account trains equipped with said first automatic train protection system in the track section during a control of trains equipped with said second automatic train protection system;

radio interfaces;

said first automatic train protection system having first wayside train protection facilities disposed at the track section, configured to transmit data through said radio interfaces to trains equipped with said second automatic train protection system and configured to receive data through said radio interfaces from the trains equipped with said second automatic train protection system; and a wayside centrally located train protection facility configured to simultaneously track trains equipped with said first automatic train protection system and trains equipped with said second automatic train protection system on the track section.

2. The rail-bound track section according to claim 1, wherein said combined train protection system is configured to provide trains equipped with said PTC system with a mission which, during a passage through the rail-bound track section, relates to a track length for which a track clear signal exists.

3. The rail-bound track section according to claim 1, wherein said combined train protection system is configured to transfer trains equipped with said PTC system to immediate and gradual or immediate and absolute braking.

4. The rail-bound track section according to claim 1, wherein said combined train protection system is configured to transfer switch settings and signal aspects having been determined and transferred by wayside safety facilities of said CBTC system to trains equipped with said PTC system.

5. A method for operating a rail-bound track section equipped with an automatic train protection system, the method comprising:

operating the automatic train protection system as a combined train protection system having a functionality of a first automatic train protection system and a functionality of a second automatic train protection system covered by the combined train protection system, the first automatic train protection system being a CBTC system and the second automatic train protection system being a PTC system;

using the combined train protection system to:

take trains equipped with the second automatic train protection system in the track section into account during a control of trains equipped with the first automatic train protection system, and take trains equipped with the first automatic train protection system in the track section into account during a control of trains equipped with the second automatic train protection system;

using first wayside train protection facilities of the first automatic train protection system disposed at the track section to transmit data exclusively through radio interfaces to trains equipped with the second automatic train protection system and to receive data through radio interfaces from the trains equipped with the second automatic train protection system; and using a wayside centrally located train protection facility to simultaneously track trains equipped with said first automatic train protection system and trains equipped with said second automatic train protection system on the track section.

6. The method according to claim 5, which further comprises operating the combined train protection system to:

use a communication protocol of the first automatic train protection system for trains equipped with the first automatic train protection system, and use a communication protocol of the second automatic train protection system for trains equipped with the second automatic train protection system.

7. The method according to claim 6, which further comprises:

operating the combined train protection system for an acquisition of data by using the first automatic train protection system as a wayside train protection system; and operating the combined train protection system for an output of data to trains equipped with the second automatic train protection system by carrying out a transformation of the data to permit it to be used for the communication protocol of the second automatic train protection system.

* * * * *